US012013176B2

(12) United States Patent
Celik

(10) Patent No.: US 12,013,176 B2
(45) Date of Patent: Jun. 18, 2024

(54) REDUCING OR ELIMINATING WOBBLE PROBLEM IN A REFRIGERATOR DRAWER

(71) Applicants: BSH Home Appliances Corporation, Irvine, CA (US); BSH Hausgeräte GmbH, Munich (DE)

(72) Inventor: Cetin Abdullah Celik, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/956,868

(22) Filed: Sep. 30, 2022

(65) Prior Publication Data

US 2024/0110746 A1 Apr. 4, 2024

(51) Int. Cl.

| | |
|---|---|
| ***F25D 25/02*** | (2006.01) |
| ***A47B 88/45*** | (2017.01) |
| ***F25D 23/02*** | (2006.01) |

(52) U.S. Cl.

CPC ..... *F25D 25/025* (2013.01); *A47B 88/45* (2017.01); *A47B 2210/0078* (2013.01); *A47B 2210/175* (2013.01)

(58) Field of Classification Search

CPC ..... F25D 25/025; F25D 25/022; A47B 2210/0078; A47B 2210/175; A47B 88/45; A47B 2210/0059; A47B 88/40; A47B 88/447; A47B 88/493; A47B 88/487; F16H 19/04

See application file for complete search history.

(56) References Cited

U.S. PATENT DOCUMENTS

| | | | | |
|---|---|---|---|---|
| 2,620,253 | A * | 12/1952 | Read | A47B 88/483 312/331 |
| 3,881,365 | A * | 5/1975 | Hardy | F16H 55/0886 74/462 |
| 7,430,937 | B2 | 10/2008 | Rotter | |
| 7,594,707 | B2 | 9/2009 | Kunkle | |
| 8,274,251 | B2 | 9/2012 | Yoo | |
| 9,982,937 | B2 | 5/2018 | Tierney | |
| 10,712,083 | B1 | 7/2020 | Choi | |
| 11,255,601 | B2 | 2/2022 | Choi | |

(Continued)

FOREIGN PATENT DOCUMENTS

| | | | |
|---|---|---|---|
| CN | 207922665 U | * | 9/2018 |
| KR | 20200069712 A | | 6/2020 |
| KR | 20200069792 A | | 6/2020 |

*Primary Examiner* — Kimberley S Wright

(74) *Attorney, Agent, or Firm* — Michael E Tschupp; Andre Pallapies; Brandon G. Braun

(57) ABSTRACT

A refrigeration appliance system can include a refrigeration compartment. The system can include a drawer positioned in the refrigeration compartment. The system can also include a gear bar assembly positioned under a bottom portion of the drawer, the gear bar assembly configured to reduce or eliminate a wobble of the drawer in response to the drawer being opened or closed. The gear bar assembly can include a gear with gear teeth extending from a base of the gear. The gear bar assembly can include a gear bar coupled to the gear. The gear bar assembly can include a toothed strip positioned adjacent to the gear and in contact with the gear teeth in response to the drawer being opened or closed.

20 Claims, 12 Drawing Sheets

(56) References Cited

U.S. PATENT DOCUMENTS

| | | | | |
|---|---|---|---|---|
| 2005/0160854 | A1* | 7/2005 | Rotter | F25D 25/025 74/422 |
| 2009/0302728 | A1* | 12/2009 | Rotter | F25D 25/025 312/405 |
| 2010/0234163 | A1* | 9/2010 | Radzevich | F16H 48/28 74/462 |
| 2010/0283365 | A1* | 11/2010 | Chen | A47B 88/487 312/334.7 |
| 2013/0334950 | A1* | 12/2013 | Kim | F25D 23/04 312/317.1 |
| 2014/0265783 | A1* | 9/2014 | Hauer | A47B 88/493 312/331 |
| 2017/0051967 | A1* | 2/2017 | Tierney | F16H 19/04 |
| 2018/0110334 | A1* | 4/2018 | Hamon | A47B 88/493 |
| 2020/0072540 | A1 | 3/2020 | Kim | |
| 2020/0173712 | A1 | 6/2020 | Choi | |
| 2021/0010743 | A1 | 1/2021 | Park | |
| 2021/0010745 | A1 | 1/2021 | Choi | |
| 2021/0010746 | A1 | 1/2021 | Choi | |
| 2021/0010747 | A1 | 1/2021 | Choi | |
| 2021/0010749 | A1 | 1/2021 | Choi | |

* cited by examiner

REDUCING OR ELIMINATING WOBBLE PROBLEM IN A REFRIGERATOR DRAWER

TECHNICAL FIELD

The present disclosure relates generally to refrigeration systems and, more particularly (although not necessarily exclusively), to drawers assembled in refrigeration systems.

BACKGROUND

Refrigerators can include drawers for a refrigeration compartment. In some refrigerators, drawers in the refrigeration compartment can exhibit a wobble when certain forces are applied to the drawers. The wobble can be especially evident when the drawer is loaded with items. For example, when the drawer is fully loaded and a user opens the drawer by holding a left or right drawer handle area, the drawer can twist and lose synchronization. The wobble can be more evident for large drawers such as chiller drawers.

DETAILED DESCRIPTION

Figure 1:
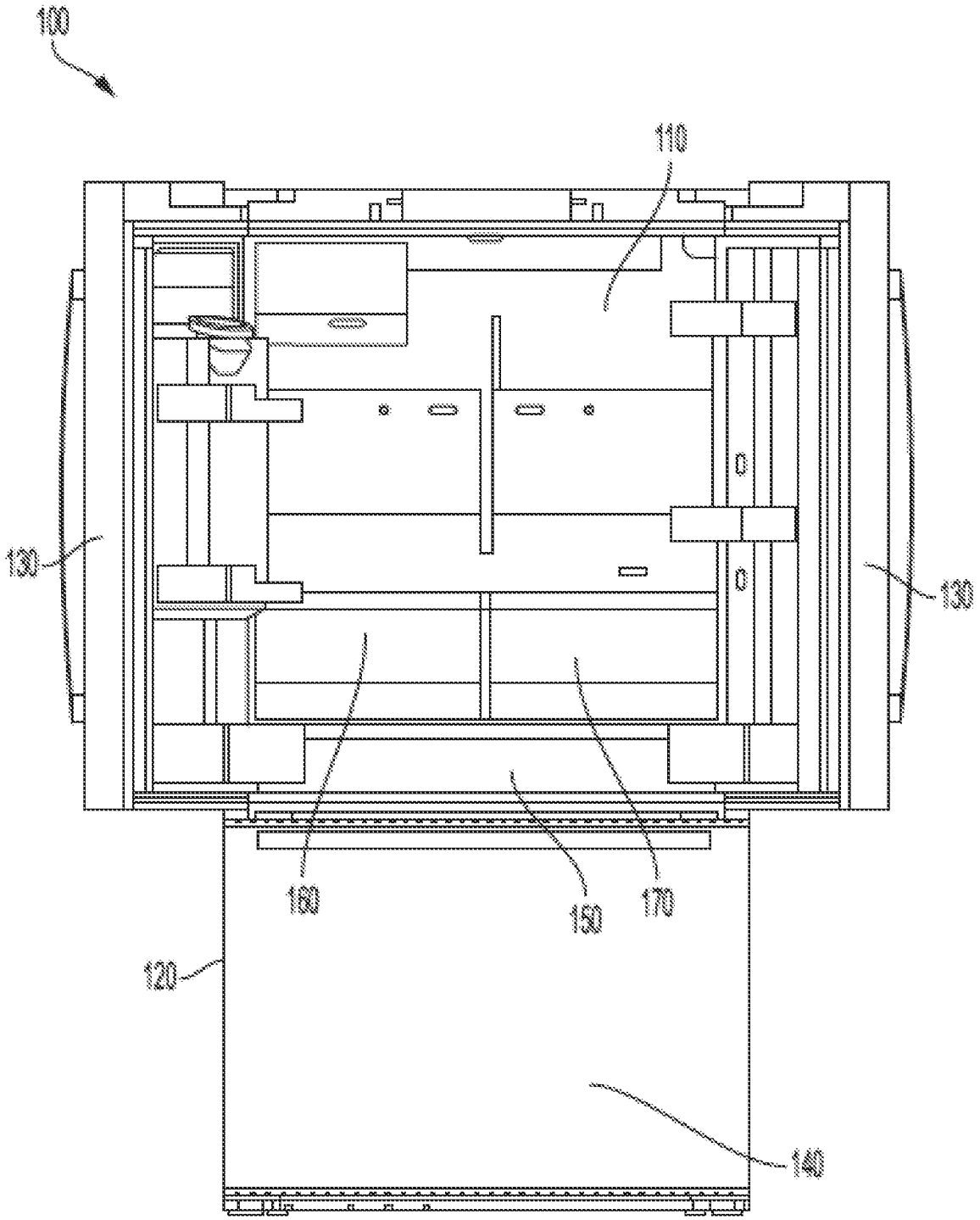
FIG. 1 is a schematic of a front view of a refrigerator that can include a drawer for a refrigeration compartment according to one example of the present disclosure.

Certain aspects and features of this disclosure relate to a gear assembly for reducing or eliminating a wobble of a drawer in a refrigeration compartment. The gear assembly can include a gear bar and at least one gear. In some examples, the at least one gear is connected to the gear bar via a snap fit. The gear can include gear teeth. The gear assembly can include a toothed strip placed adjacent to the gear. The toothed strip can contact the gear teeth when the drawer is opened or closed. In some examples, the gear teeth are angled to reduce an area of contact between the gear teeth and the toothed strip. The reduced area of contact can reduce sound when the drawer is opened or closed. The parts of the gear bar assembly can be easily assembled or disassembled by a user. The gear bar assembly can provide a simple, low-cost solution to a wobble problem associated with drawers in a refrigeration compartment.

A mechanical solution to the wobble problem can be created under a drawer body, independent of drawer rails and type of drawer. In some examples, the gear bar assembly can consist of the gear bar, two gears, and two gear holders. Each of the two gears can be manually attached without tools to each end of the gear bar. The two gears can be modified to prevent each end of the gear bar from turning freely. The gear teeth can be symmetrical and angled to reduce friction and noise generation. The gear bar with attached gears can be manually connected to the two gear holders via snap fit. Each of the two gear holders can be fixed with screws to a liner of the refrigerator. Two toothed strips can be added to a bottom portion of the drawer so that the drawer can pass over the gear bar assembly without wobbling while the drawer is opened or closed. The two toothed strips on the bottom portion of the drawer can be configured to contact the gear teeth when the drawer is attached to the drawer rails in sidewalls of the refrigeration compartment. The gear bar assembly can be compatible with all kinds of drawer rails, including "C" shape rails or "Quadro" rails.

In another example, the gear bar assembly can consist of the gear bar, the two gears, and the two toothed strips. The gear bar with attached two gears can be embedded into the bottom portion of the drawer. The two toothed strips can be attached to the liner of the refrigerator so that the drawer with embedded gear bar assembly can pass over the two toothed strips without wobbling while the drawer is opened or closed. The gear teeth of the two gears can be configured to contact the two toothed strips when the drawer is attached to the drawer rails in the sidewalls of the refrigeration compartment. As with other examples, the gear teeth can be angled to reduce friction and noise generation.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a front view of a refrigerator 100 that can include a drawer for a refrigeration compartment 110 according to one example of the present disclosure. In some examples, the refrigerator 100 can be a bottom mount refrigerator. The refrigerator 100 can include the refrigeration compartment 110 and a freezer compartment 120. Doors 130 are provided for the refrigeration compartment 110 and a door 140 is provided for the freezer compartment 120. The refrigeration compartment 110 can include several drawers, including a chiller drawer 150, a left crisper drawer 160, and a right crisper drawer 170. In some examples, each of the several drawers can wobble when opened or closed.

Figure 2:
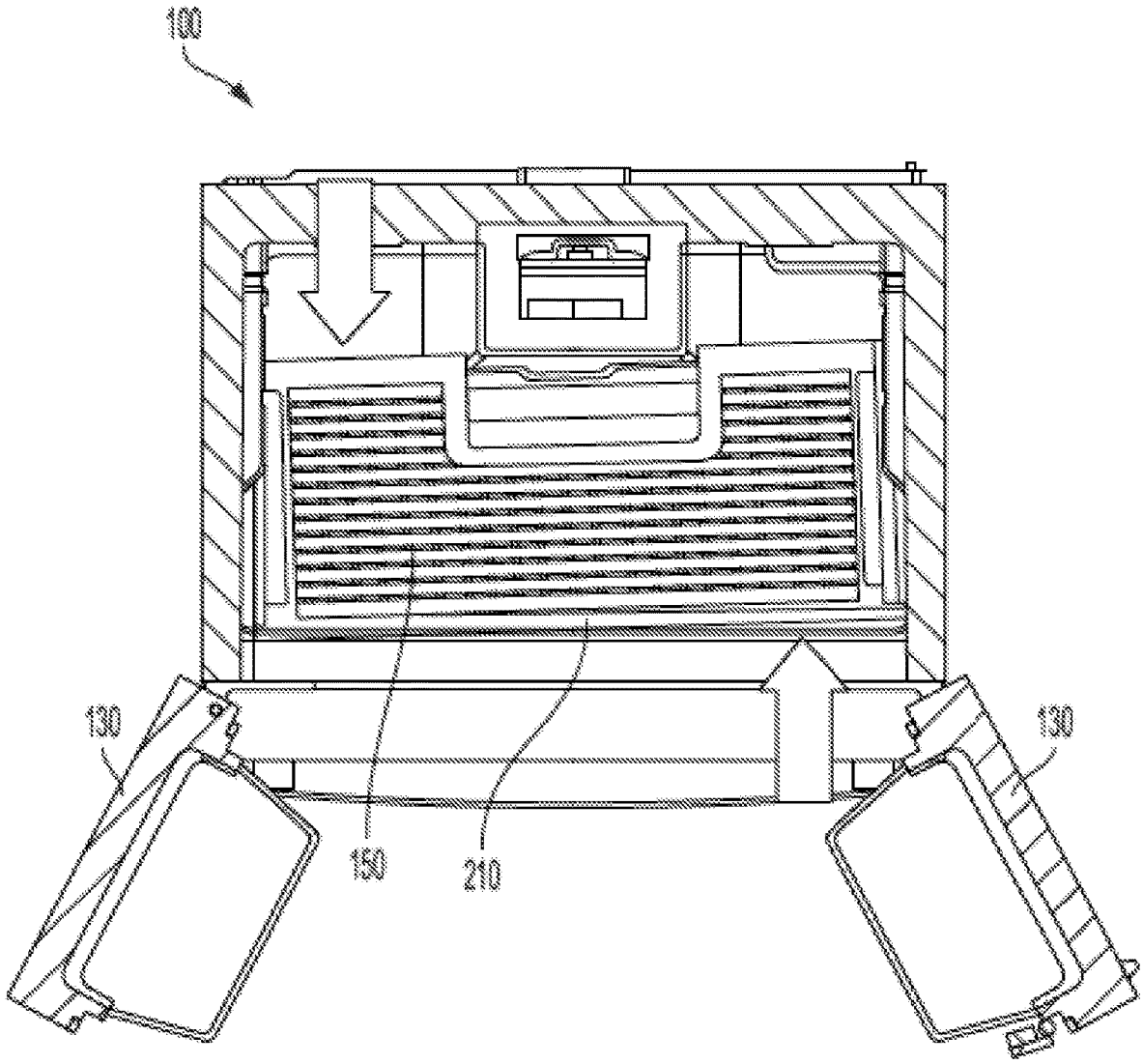
FIG. 2 is a schematic of a top view of a refrigerator depicting a wobble problem for a drawer according to one example of the present disclosure.

FIG. 2 is a schematic of a top view of a refrigerator 100 depicting a wobble problem for a drawer according to one example of the present disclosure. The top view of the refrigerator 100 includes doors 130 for a refrigeration compartment 110 and a chiller drawer 150 in the refrigeration compartment 110. The chiller drawer 150 can include a front handle 210. In some examples, when a user applies a force away from a center of the front handle 210 to open or close the chiller drawer 150, the chiller drawer 150 can experience a torque and twist or wobble as depicted by the arrows and a slant in the chiller drawer 150.

Figures 3A, 3B, 3C:
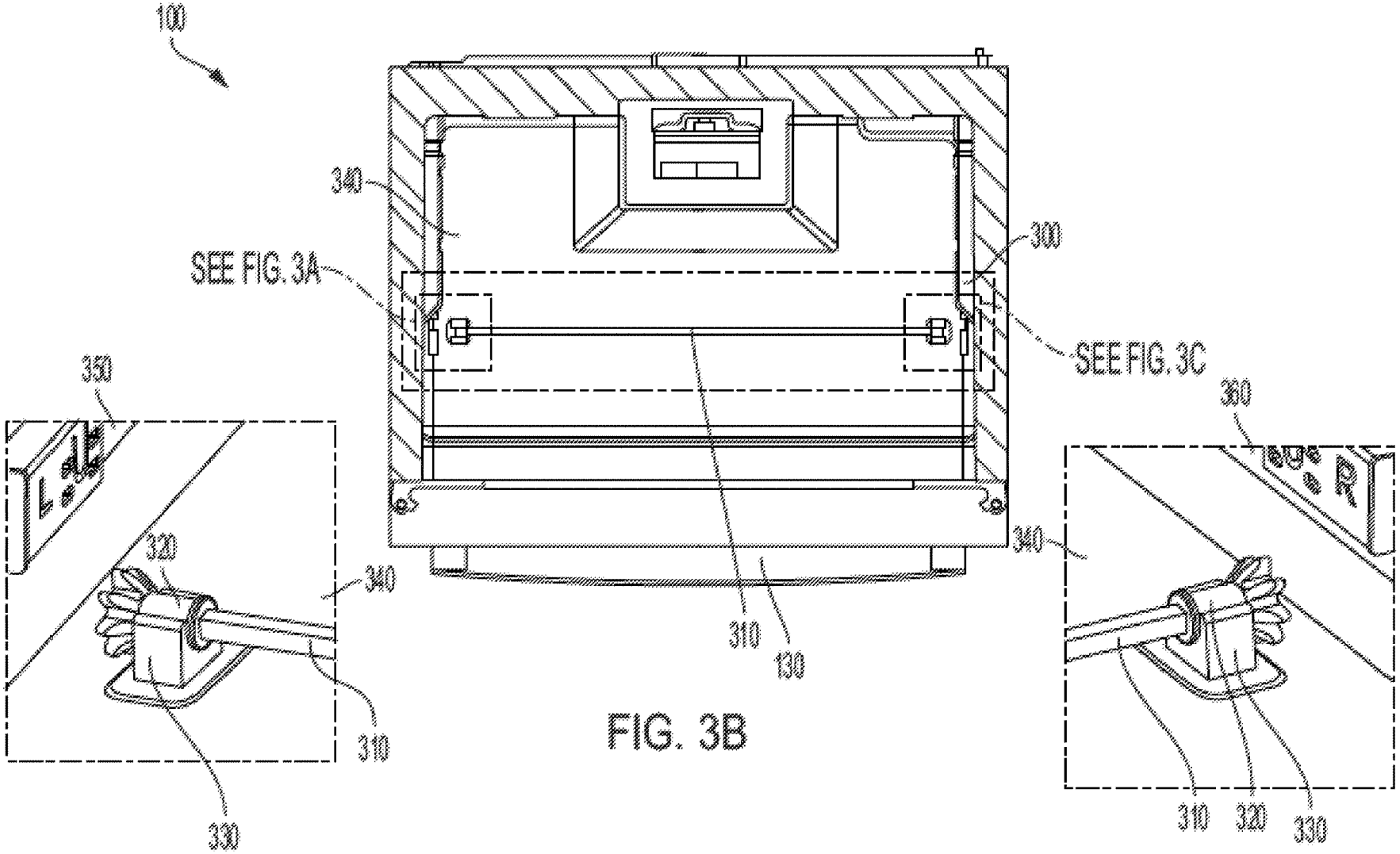
FIG. 3A is a schematic of a perspective view of a left end of a gear bar assembly for eliminating a wobble problem for a drawer according to one example of the present disclosure.
FIG. 3B is a schematic of a top view of a refrigerator that includes a gear bar assembly for eliminating a wobble problem for a drawer according to one example of the present disclosure.
FIG. 3C is a schematic of a perspective view of a right end of a gear bar assembly for eliminating a wobble problem for a drawer according to one example of the present disclosure.

FIG. 3A is a schematic of a perspective view 350 of a left end of a gear bar assembly 300 for eliminating a wobble problem for a drawer according to one example of the present disclosure. The perspective view 350 shows a gear 320 attached to a left end of a gear bar 310. The gear 320 can be attached to the end of the gear bar 310 by a snap fit. The gear 320 and the gear bar 310 are held in place by a gear holder 330, which is attached to a refrigerator liner 340. FIG. 3B is a schematic of a top view of a refrigerator 100 that includes the gear bar assembly 300. The refrigerator 100 includes doors 130, the refrigerator liner 340, and the gear bar assembly 300. Drawers are not present in the schematic of FIG. 3B. FIG. 3C is a schematic of a perspective view 360 of a right end of the gear bar assembly 300. The perspective view 360 shows a second gear 320 attached to the right end of the gear bar 310. The second gear 320 and gear bar 310 are held in place by another gear holder 330, which is attached to the refrigerator liner 340.

Figure 4:
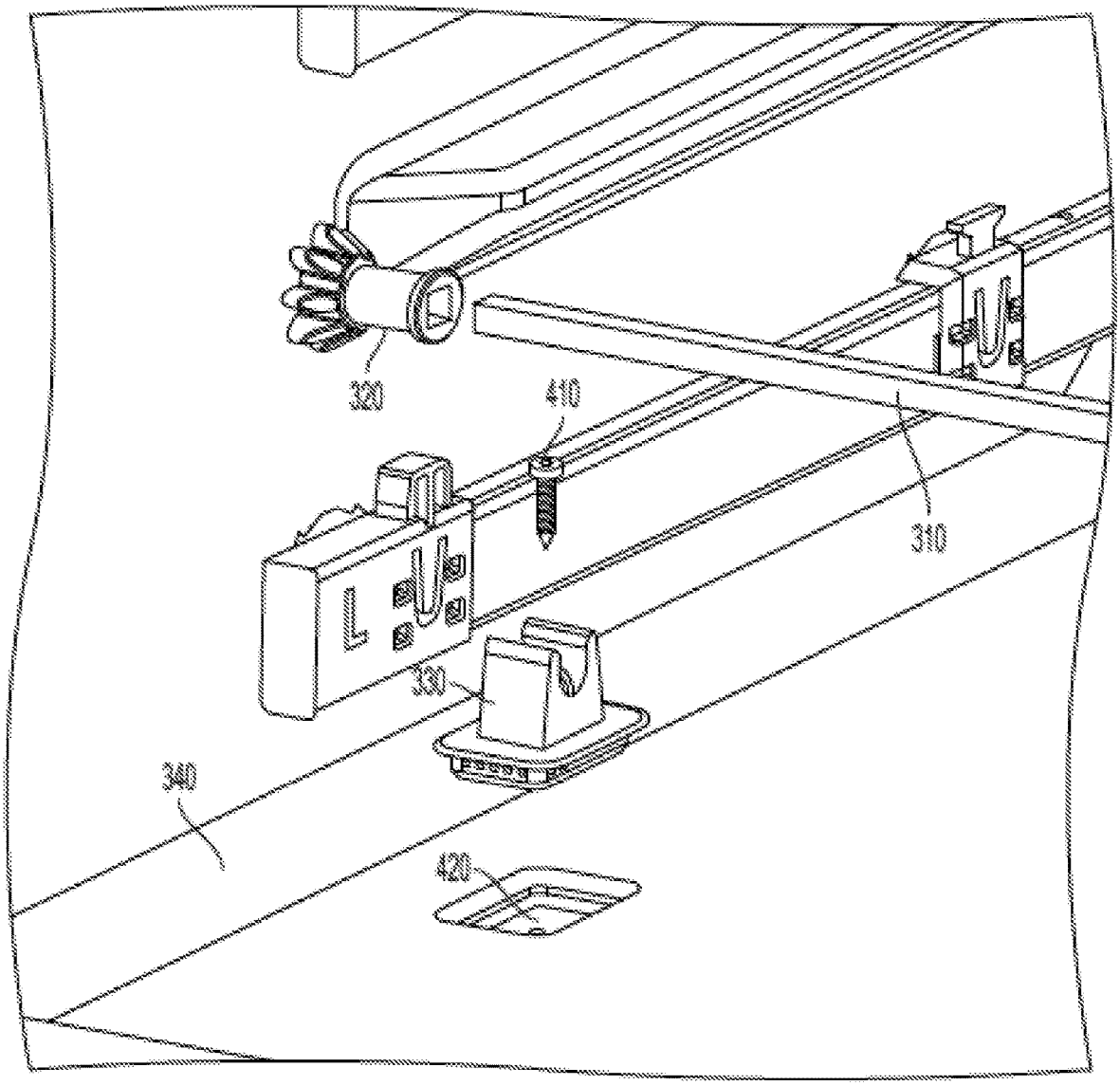
FIG. 4 is a schematic of a left side of a gear bar assembly for eliminating a wobble problem for a drawer according to one example of the present disclosure.

FIG. 4 is a schematic of a left side of a gear bar assembly 300 for eliminating a wobble problem for a drawer according to one example of the present disclosure. The schematic includes a gear bar 310, a gear 320, a gear holder 330, a screw, a refrigerator liner 340, and an indentation 420 in the refrigerator liner 340. The gear holder 330 can be placed within the indentation 420 in the refrigerator liner 340 and connected to the refrigerator liner 340 using the screw 410. The gear 320 can be attached to an end of the gear bar 310 by a snap fit. The gear 320 and gear bar 310 can be held in place by the gear holder 330 by a snap-fit connection between the gear 320 and the gear holder 330.

Figure 5:
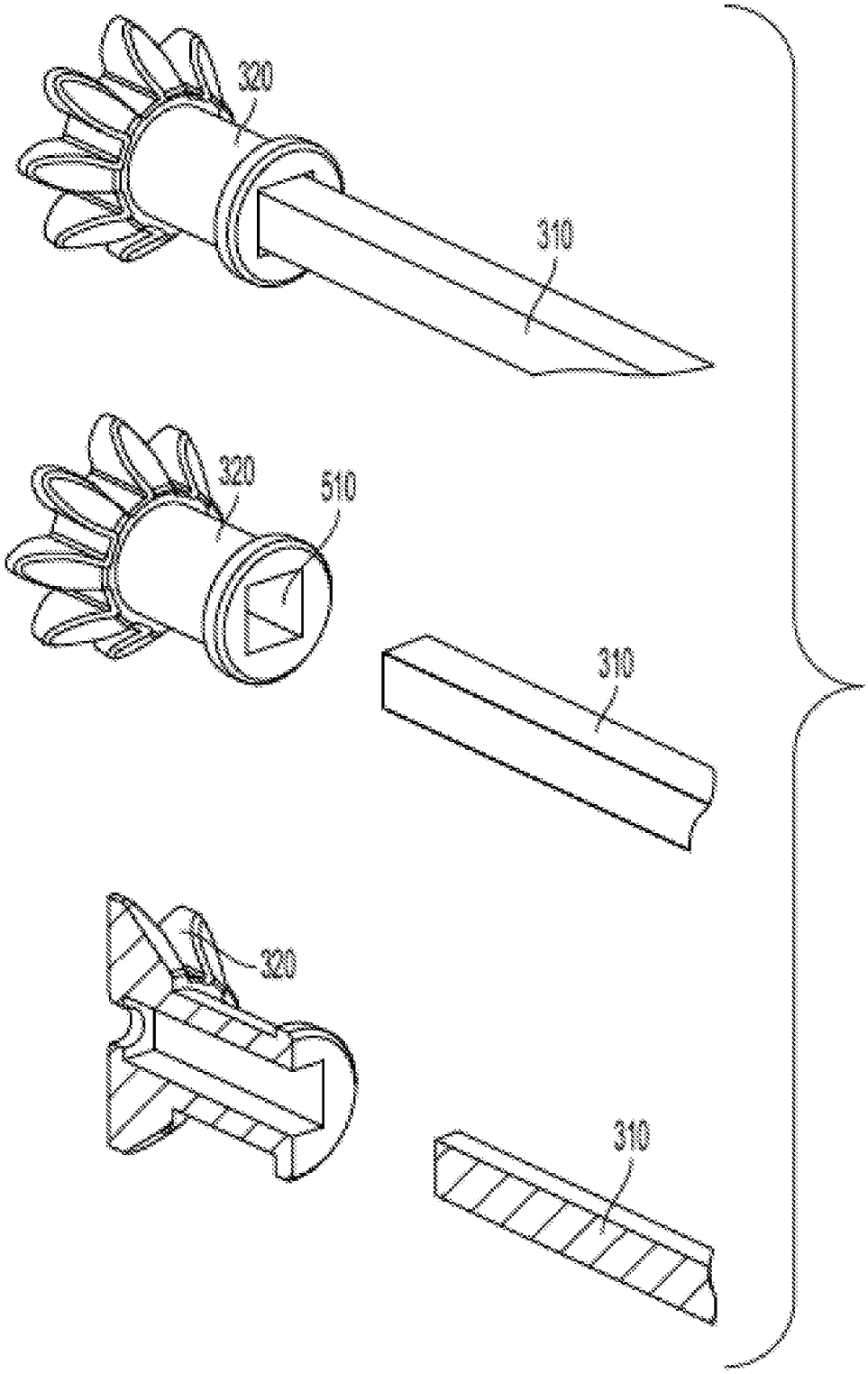
FIG. 5 is a schematic depicting multiple views of an insertion of a gear bar into a gear for a gear bar assembly according to one example of the present disclosure.

FIG. 5 is a schematic depicting multiple views of an insertion of a gear bar 310 into a gear 320 for a gear bar assembly 300 according to one example of the present disclosure. The gear bar 310 has a rectangular cross section. The gear 320 includes a rectangular shaped cavity 510. An end of the gear bar 310 can fit into the rectangular shaped cavity 510 by a snap fit. The gear bar 310 fits into the gear 320 in such a way that the gear bar 310 is prevented from turning freely.

Figure 6:
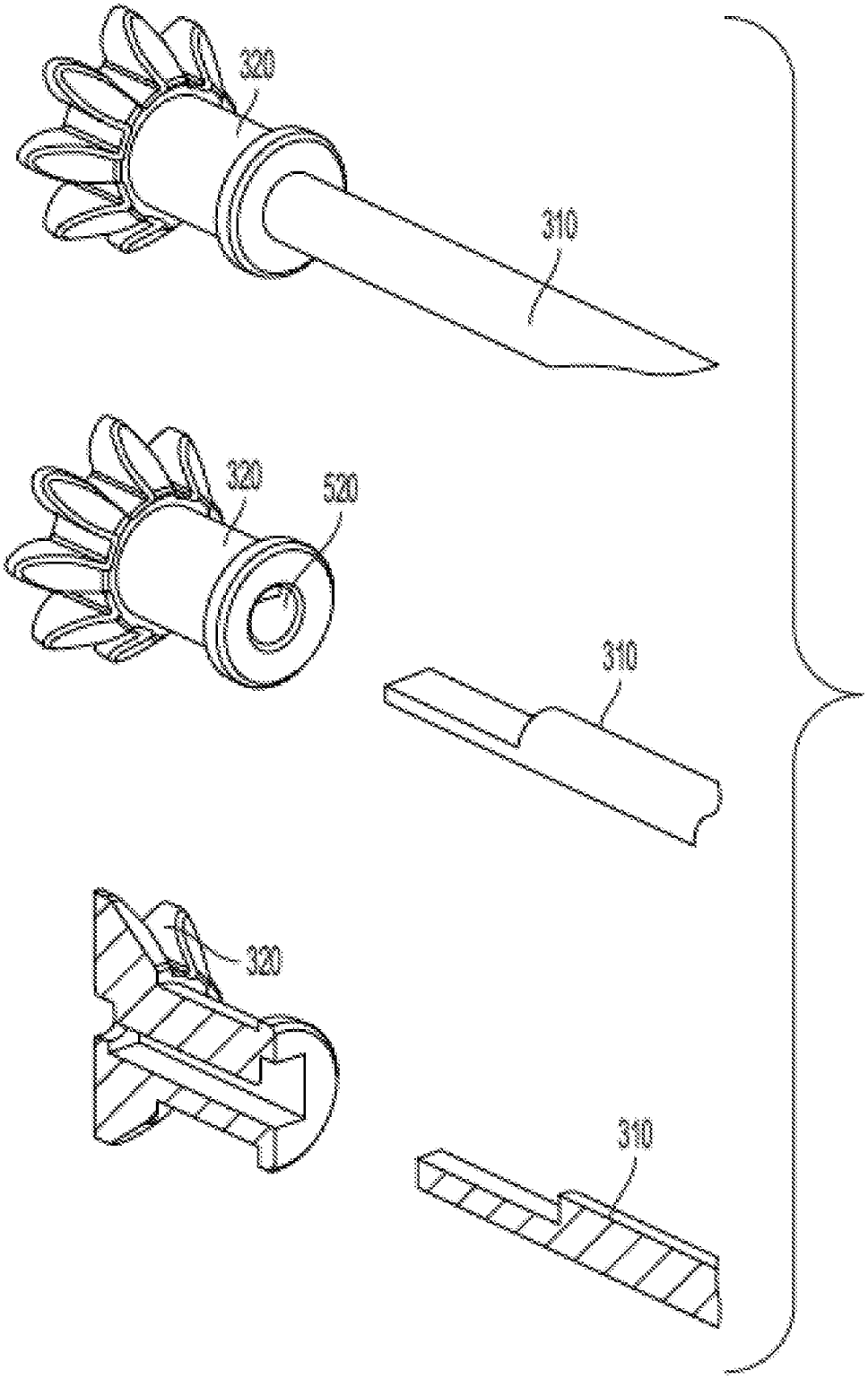
FIG. 6 is a schematic depicting multiple views of an insertion of an alternate gear bar into a gear for a gear bar assembly according to one example of the present disclosure.

FIG. 6 is a schematic depicting multiple views of an insertion of an alternate gear bar 310 into a gear 320 for a gear bar assembly 300 according to one example of the present disclosure. A body of the gear bar 310 has a circular cross section. An end of the gear bar 310 is configured to have a "half-moon" cross section. The gear 320 includes a "half-moon" shaped cavity 520. The end of the gear bar 310 can fit into the "half-moon" shaped cavity 520 by a snap fit. The gear bar 310 fits into the gear 320 in such a way that the gear bar 310 is prevented from turning freely.

Figure 7C:
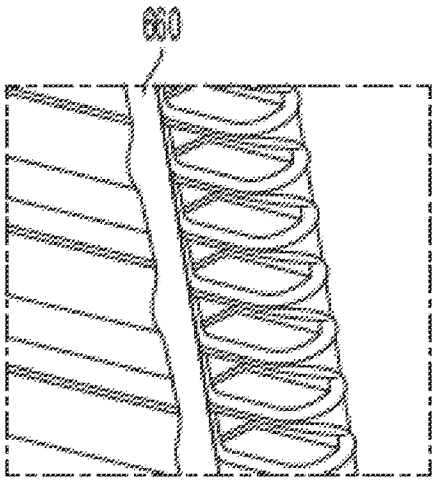
FIG. 7C is a perspective view of a portion of a right toothed strip on a bottom portion of a chiller drawer according to one example of the present disclosure.
Figure 7B:
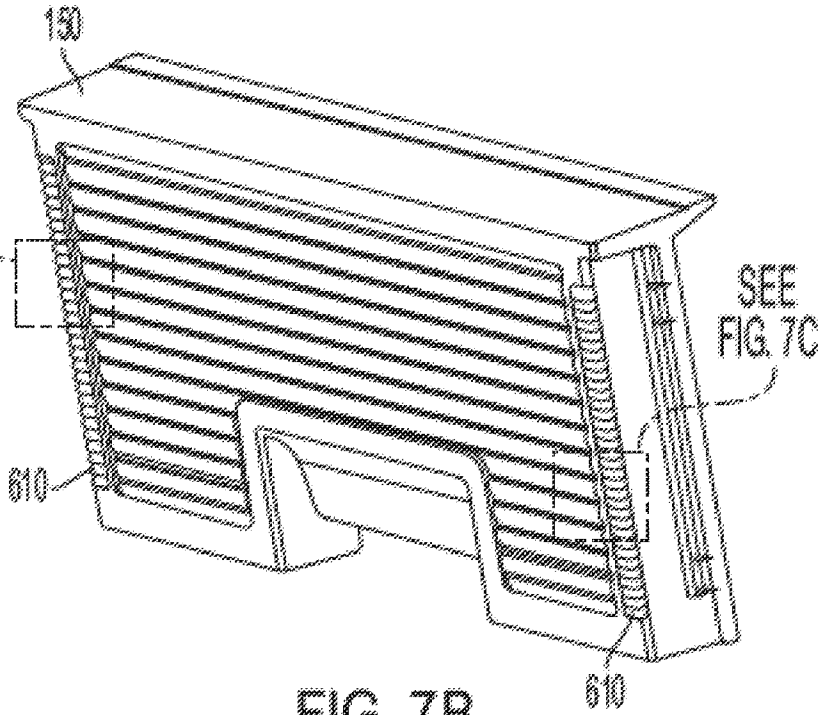
FIG. 7B is a schematic of a perspective view of a chiller drawer having two toothed strips on a bottom portion of the chiller drawer according to one example of the present disclosure.
Figure 7A:
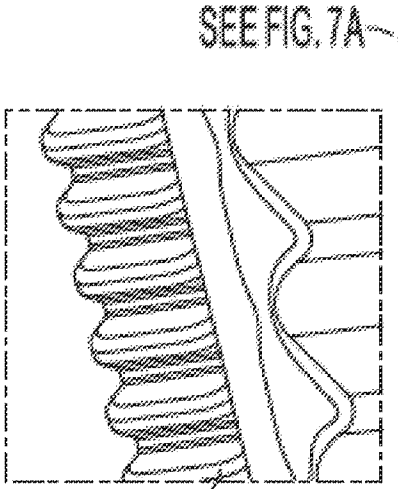
FIG. 7A is a perspective view of a portion of a left toothed strip on a bottom portion of a chiller drawer according to one example of the present disclosure.

FIG. 7A is a perspective view 650 of a portion of a left toothed strip on a bottom portion of a chiller drawer 150 according to one example of the present disclosure. FIG. 7B is a schematic of a perspective view of the chiller drawer 150 having two toothed strips 610 on the bottom portion of the chiller drawer 150. The two toothed strips 610 can be added to a bottom portion of the chiller drawer 150 so that the chiller drawer 150 can pass over a gear bar assembly 300 without wobbling while the chiller drawer 150 is opened or closed. FIG. 7C is a perspective view 660 of a portion of a right toothed strip on the bottom portion of the chiller drawer 150.

Figure 8:
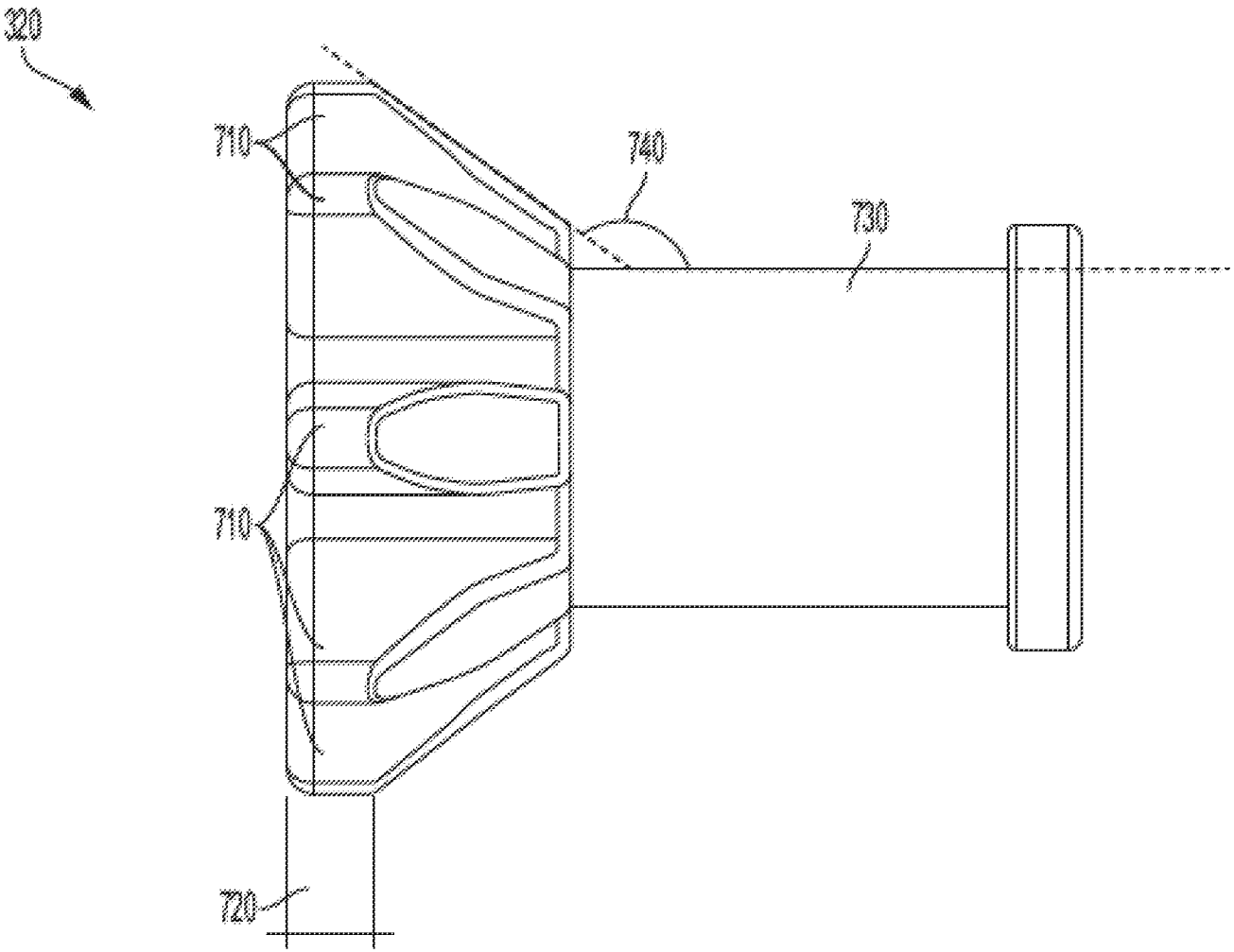
FIG. 8 is a schematic of a side view of a gear with gear teeth according to one example of the present disclosure.

FIG. 8 is a schematic of a side view of a gear 320 with gear teeth 710 according to one example of the present disclosure. The gear 320 includes body portion 730 and the gear teeth 710 on the left side of the gear 320. Each tooth of the gear teeth 710 includes an outer edge and a width 720 of the outer edge of a gear tooth is shown in the schematic. The gear teeth 710 are angled to reduce the width 720 of the outer edge of each gear tooth and reduce an area of contact between the gear teeth 710 and a toothed strip. The angled gear teeth 710 can be defined by the angle 740 between the body of the gear 320 and an inclined surface of each gear tooth. Increasing the angle 740 can reduce the width 720 of the outer edge of each gear tooth. The gear teeth 710 are angled to reduce friction and noise generation when a drawer passes over the gear 320 when the drawer is opened or closed.

Figure 9:
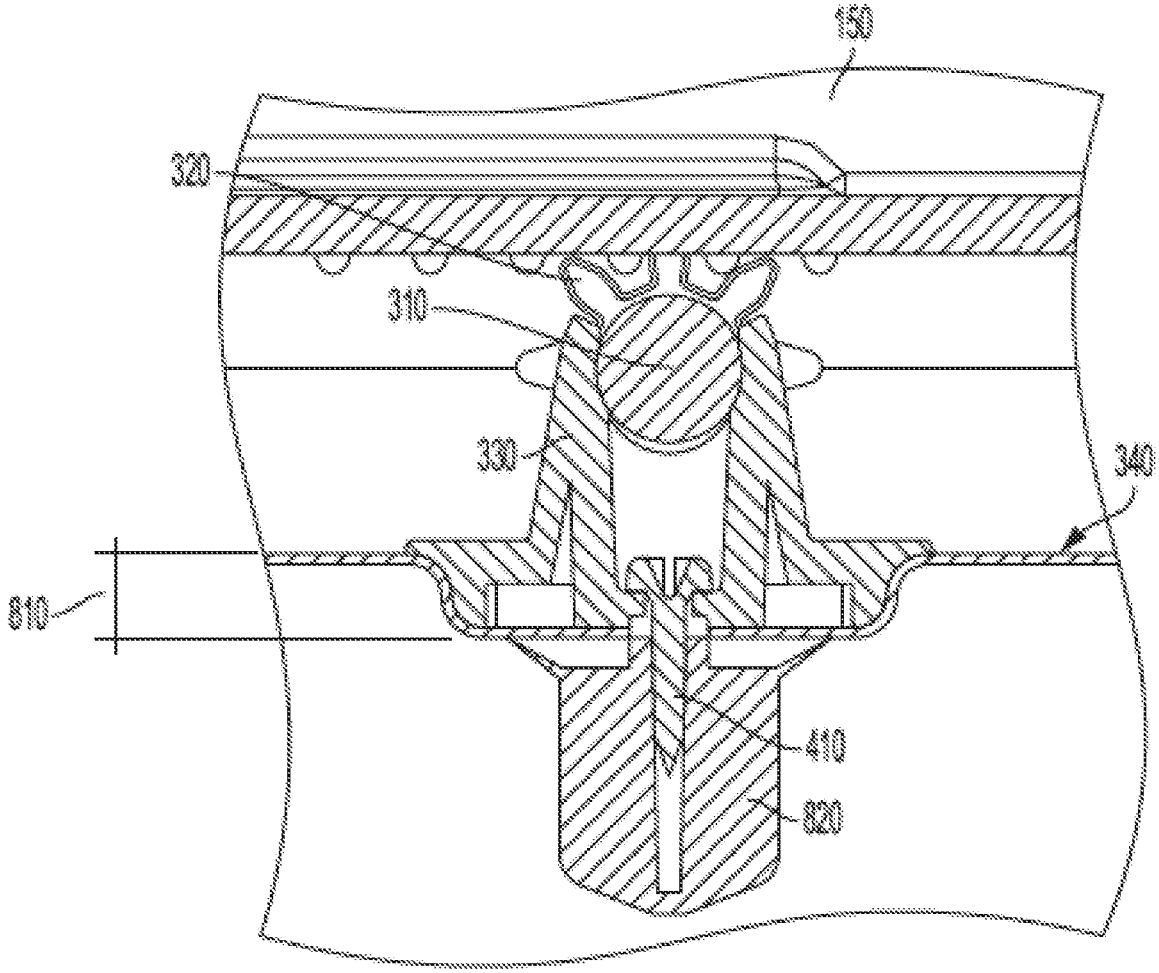
FIG. 9 is a schematic of a cross sectional view of an assembled gear bar assembly in contact with a bottom portion of a chiller drawer according to one example of the present disclosure.

FIG. 9 is a schematic of a cross sectional view of an assembled gear bar assembly 300 in contact with a bottom portion of a chiller drawer 150 according to one example of the present disclosure. The gear bar assembly 300 includes a gear bar 310, a gear 320, a screw 410, and a gear holder 330. The schematic also depicts a refrigerator liner 340, an indentation 420 in the refrigerator liner 340, a width of the indentation 420, and a screw reinforcement piece 820. The gear holder 330 can be placed within the indentation 420 in the refrigerator liner 340 and connected to the refrigerator liner 340 using the screw 410. The screw 410 passes through a hole in the gear holder 330 and a hole in the indentation 420 into the screw reinforcement piece 820. The gear 320 can be attached to an end of the gear bar 310 by a snap fit. The gear 320 and gear bar 310 can be held in place by the gear holder 330 by a snap-fit connection between the gear 320 and the gear holder 330. Toothed strips on the bottom portion of the chiller drawer 150 are configured to contact gear teeth 710 of the gear 320 when the chiller drawer 150 is opened or closed. The gear bar assembly 300 allows the chiller drawer 150 to open or close without a wobble problem.

Figure 10A:
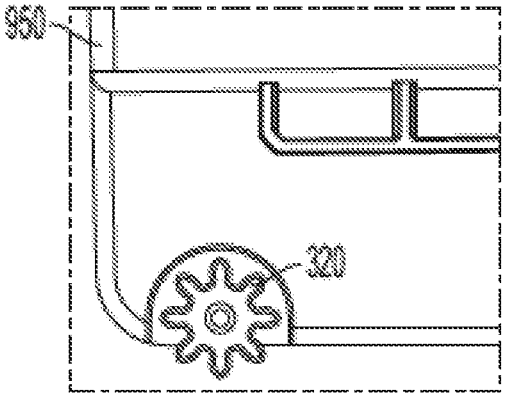
FIG. 10A is a schematic of a side view of a back of a bottom portion of a left crisper drawer according to one example of the present disclosure.
Figure 10B:
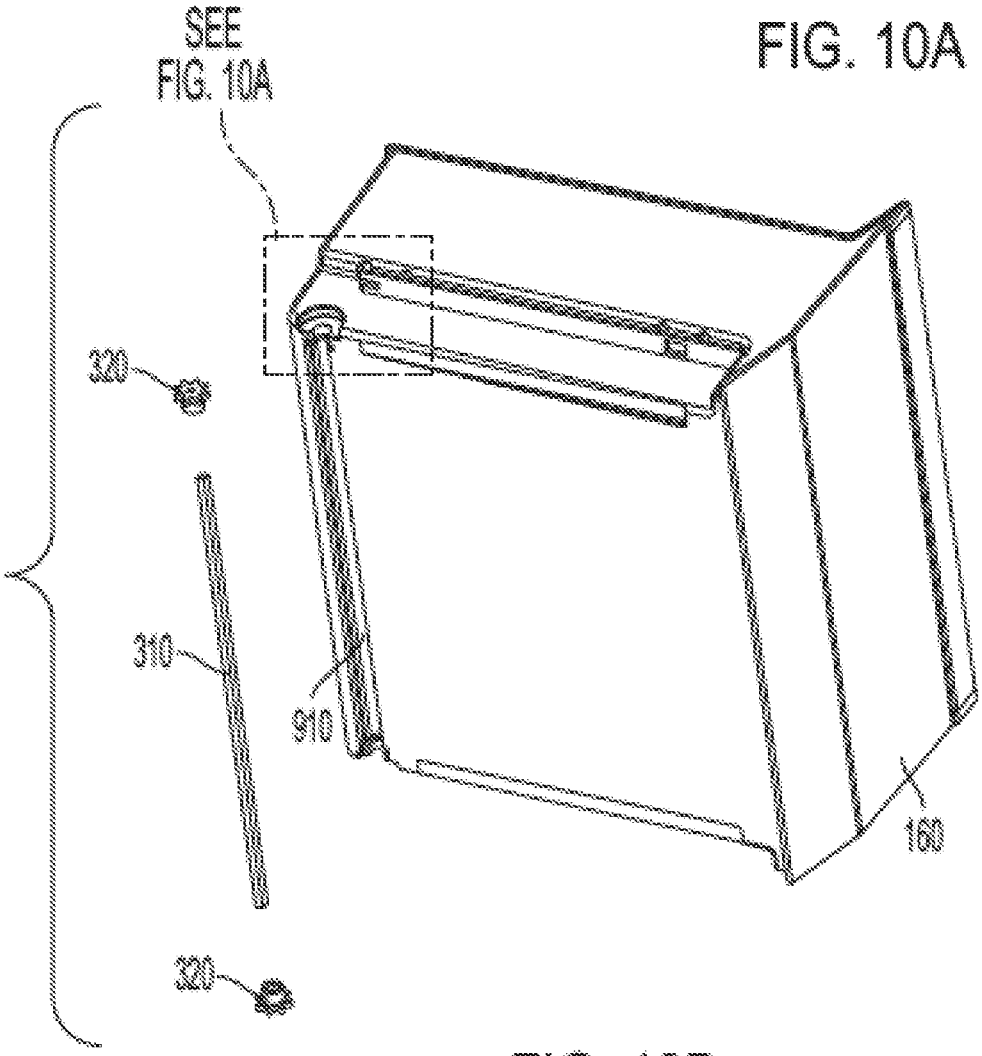
FIG. 10B is a schematic depicting a left crisper drawer with a gear bar assembly embedded in a bottom portion of the left crisper drawer according to one example of the present disclosure.

FIG. 10A is a schematic of a side view 950 of a back of a bottom portion of a left crisper drawer 160 according to one example of the present disclosure. The side view 950 depicts a gear 320 of the gear bar assembly 300 embedded in the bottom portion of the left crisper drawer 160. FIG. 10B is a schematic depicting the left crisper drawer 160 with the gear bar assembly 300 embedded in a bottom portion of the left crisper drawer 160. The schematic of the left crisper drawer 160 includes the left crisper drawer 160, a gear bar 310, and two gears 320. Each gear 320 can be attached to an end of the gear bar 310 by a snap fit. The bottom portion of the left crisper drawer 160 includes a drawer indentation 910. The gear bar 310 with attached gears 320 can be embedded into the drawer indentation 910 by snap fit.

Figure 11:
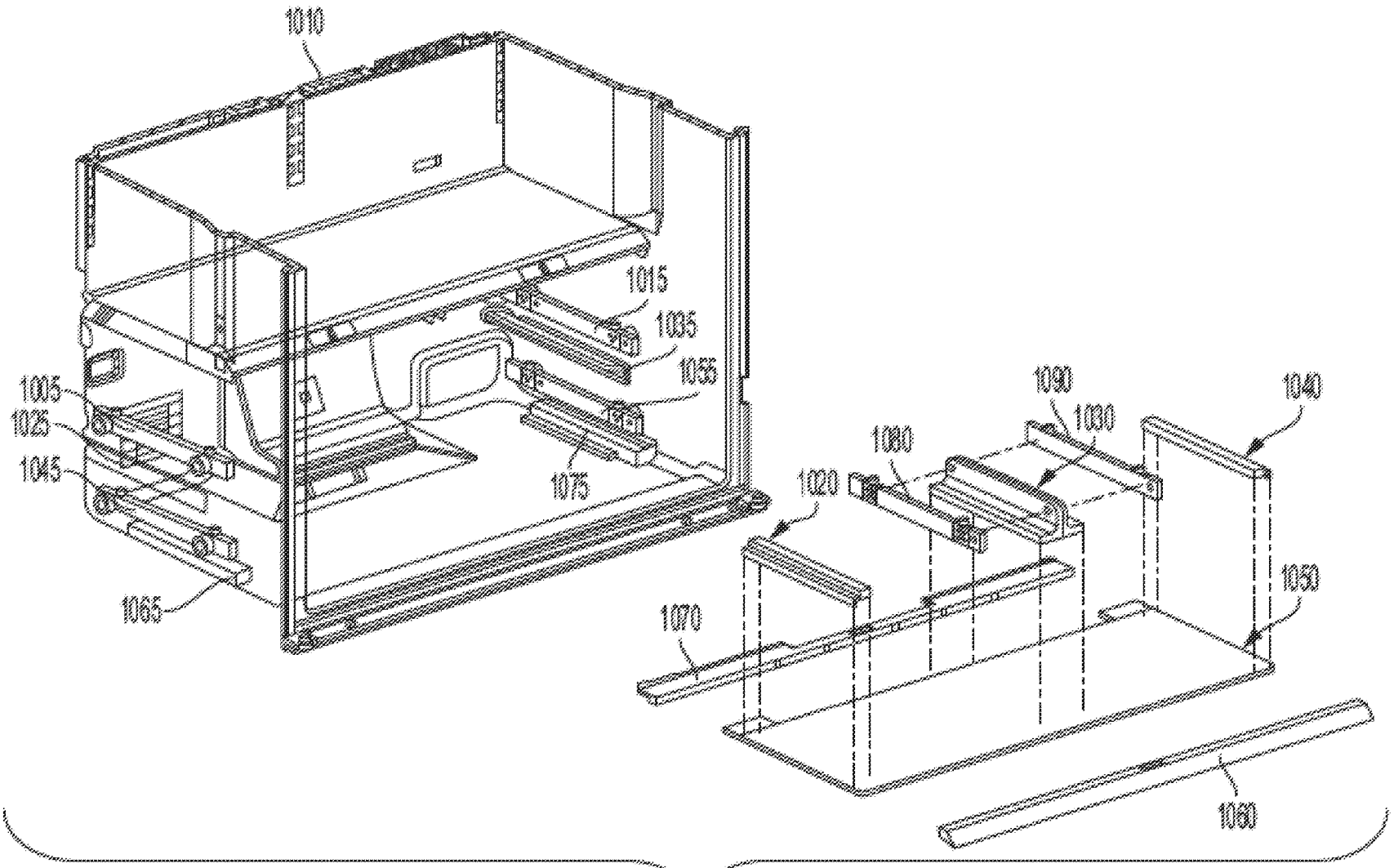
FIG. 11 is a schematic of a perspective view of assembly parts for drawers having embedded gear assemblies and a lower portion of a refrigeration compartment for receiving the drawers according to one example of the present disclosure.

FIG. 11 is a schematic of a perspective view of assembly parts for drawers having embedded gear bar assemblies 300 and a lower portion 1010 of a refrigeration compartment 110 for receiving the drawers according to one example of the present disclosure. The assembly parts include a left gear way 1020 for a left crisper drawer 160, a middle gear way 1030, a right gear way 1040 for a right crisper drawer 170, and a glass plate 1050. The glass plate 1050 includes a front attachment 1060 and a back attachment 1070. In some examples, the left gear way 1020, the middle gear way 1030, and the right gear way 1040 can be affixed to the glass plate 1050 with double-sided tape.

The assembly parts also include a right drawer rail 1080 for the left crisper drawer 160 and a left drawer rail 1090 for the right crisper drawer 170. The right drawer rail 1080 and the left drawer rail 1090 can attach to the middle gear way 1030. The left gear way 1020 and the right gear way 1040 each include a toothed strip. The middle gear way 1030 includes two toothed strips, one on each side of the middle gear way 1030.

The lower portion 1010 of the refrigeration compartment 110 includes a left drawer rail 1005 for the left crisper drawer 160, a left platform 1025 for the glass plate 1050, a left drawer rail 1045 for a chiller drawer 150, a left gear way 1065 for the chiller drawer 150, a right drawer rail 1015 for the right crisper drawer 170, a right platform 1035 for the glass plate 1050, a right drawer rail 1055 for the chiller drawer 150, and a right gear way 1075 for the chiller drawer 150. The left gear way 1065 and the right gear way 1075 each include a toothed strip. The glass plate 1050 with other assembled parts attached to the glass plate 1050 can be inserted into the lower portion 1010 of the refrigeration compartment 110 by placing the glass plate 1050 onto the left platform 1025 and the right platform 1035.

The left crisper drawer 160 with a gear bar assembly 300 embedded in a bottom portion of the left crisper drawer 160 can be inserted into the lower portion 1010 of the refrigeration compartment 110. Sides of the left crisper drawer 160 can be attached to the left drawer rail 1005 for the left crisper drawer 160 and the right drawer rail 1080. Gear teeth 710 of the gear bar assembly 300 of the left crisper drawer 160 can contact the toothed strips 610 of the left drawer rail 1005 and the right drawer rail 1080 when the left crisper drawer 160 is attached to the left drawer rail 1005 and the right drawer rail 1080. The left crisper drawer 160 with the embedded gear bar assembly 300 can open and close without wobble when inserted into the lower portion 1010 of the refrigeration compartment 110.

The right crisper drawer 170 with a gear bar assembly 300 embedded in a bottom portion of the right crisper drawer 170 can be inserted into the lower portion 1010 of the refrigeration compartment 110. Sides of the right crisper drawer 170 can be attached to the left drawer rail 1090 and the right drawer rail 1015 for the right crisper drawer 170. Gear teeth 710 of the gear bar assembly 300 of the right crisper drawer 170 can contact the toothed strips 610 of the left drawer rail 1090 and the right drawer rail 1015 when the right crisper drawer 170 is attached to the left drawer rail 1090 and the right drawer rail 1015. The right crisper drawer 170 with the embedded gear bar assembly 300 can open and close without wobble when inserted into the lower portion 1010 of the refrigeration compartment 110.

The chiller drawer 150 with a gear bar assembly 300 embedded in a bottom portion of the chiller drawer 150 can be inserted into the lower portion 1010 of the refrigeration compartment 110. Sides of the chiller drawer 150 can be attached to the left drawer rail 1045 for the chiller drawer 150 and the right drawer rail 1055 for the chiller drawer 150. Gear teeth 710 of the gear bar assembly 300 of the chiller drawer 150 can contact the toothed strips 610 of the left drawer rail 1045 and the right drawer rail 1055 when the chiller drawer 150 is attached to the left drawer rail 1045 and the right drawer rail 1055. The chiller drawer 150 with the embedded gear bar assembly 300 can open and close without wobble when inserted into the lower portion 1010 of the refrigeration compartment 110. The glass plate 1050 with the front attachment 1060 and back attachment 1070 can provide a cover over the chiller drawer 150 when the chiller drawer 150 is fully closed.

Figure 12:
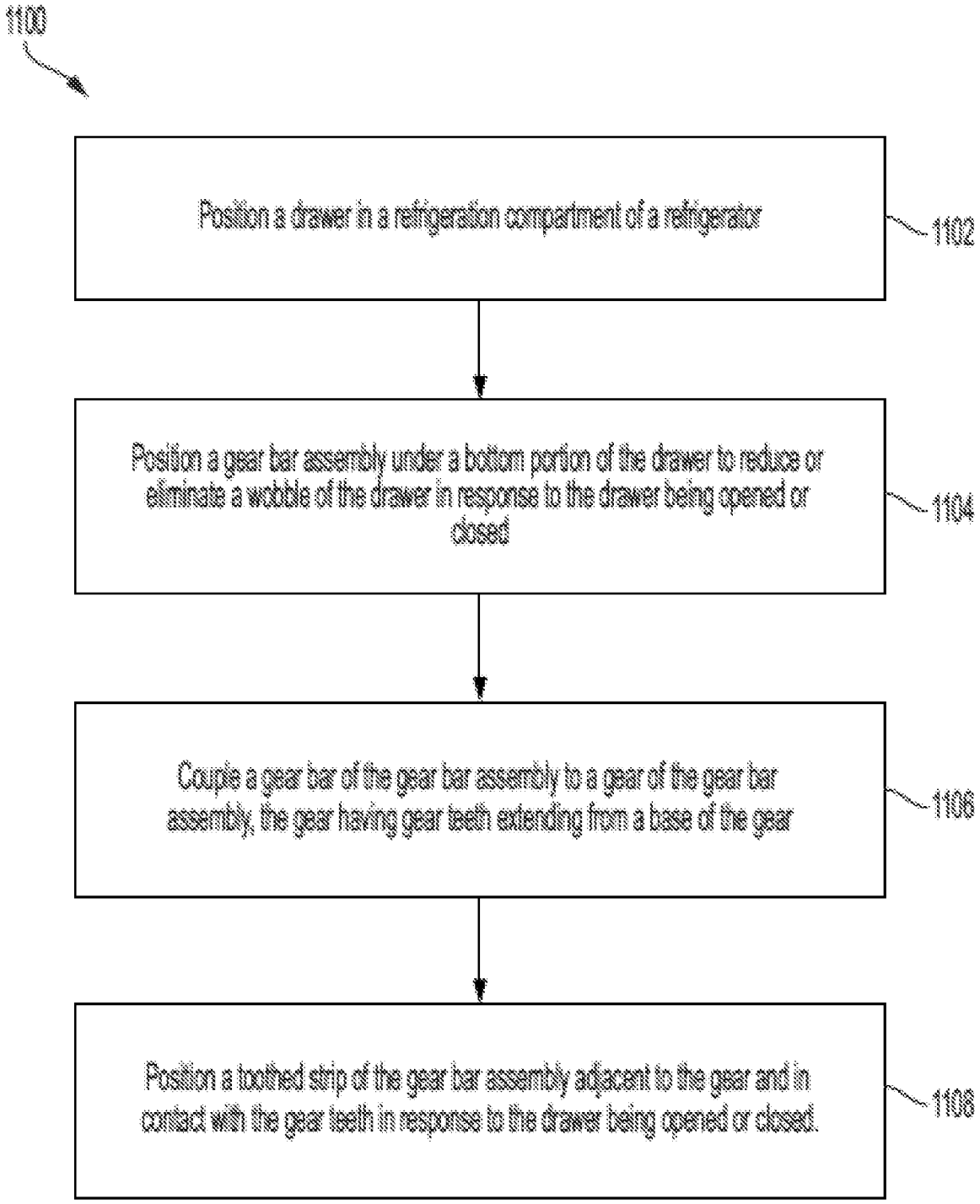
FIG. 12 is a flowchart of an example of a process of assembling a gear bar assembly for reducing or eliminating a wobble of a drawer in a refrigeration compartment according to one example of the present disclosure.

FIG. 12 is a flowchart of an example of a process 1100 of assembling a gear bar assembly 300 for reducing or eliminating a wobble of a drawer in a refrigeration compartment 110 according to one example of the present disclosure. At block 1102, the process 1100 involves positioning a drawer in the refrigeration compartment 110 of a refrigerator 100. The drawer can be a chiller drawer 150, a left crisper drawer 160, or a right crisper drawer 170. The drawer can be attached to drawer rails in sidewalls of the refrigeration compartment 110.

At block 1104, the process 1100 involves positioning the gear bar assembly 300 under a bottom of the drawer to reduce or eliminate a wobble of the drawer in response to the drawer being opened or closed. The gear bar assembly 300 can include a gear bar 310, gear 320, and a toothed strip 610. In some examples, the gear bar assembly 300 can include at least one gear holder 330 to attach the gear bar assembly 300 to a refrigerator liner 340 of the refrigeration compartment 110. In some examples, the gear bar 310 and gear 320 can be embedded in a bottom portion of the drawer.

At block 1106, the process 1100 involves coupling the gear bar 310 to the gear 320, the gear 320 having gear teeth 710 extending from a base of the gear 320. The gear bar 310 can be coupled to the gear 320 with a snap fit. In some examples, the gear bar 310 can be coupled to more than one gear 320.

At block 1108, the process 1100 involves positioning a toothed strip 610 of the gear bar assembly 300 adjacent to the gear 320 and in contact with the gear teeth 710 in response to the drawer being opened or closed. In some examples, the toothed strip 610 can be attached to the bottom portion of the drawer. In some examples, the toothed strip 610 can be attached to the refrigerator liner 340 of the refrigeration compartment 110 or to a glass plate 1050. The gear teeth 710 can be angled to reduce a contact area with the toothed strip 610.

The foregoing description of certain examples, including illustrated examples, has been presented only for the purpose of illustration and description and is not intended to be exhaustive or to limit the disclosure to the precise forms disclosed. Numerous modifications, adaptations, combinations, and uses thereof are possible without departing from the scope of the disclosure.

What is claimed is:

1. A refrigeration appliance comprising:

a refrigeration compartment;

a drawer positioned in the refrigeration compartment; and a gear bar assembly positioned under a bottom portion of the drawer, the gear bar assembly configured to reduce or eliminate a wobble of the drawer in response to the drawer being opened or closed, the gear bar assembly comprising:

a gear with gear teeth extending from a base of the gear;

a gear bar coupled to the gear; and a toothed strip positioned adjacent to the gear and in contact with the gear teeth in response to the drawer being opened or closed, wherein each gear tooth of the gear teeth comprises a flat outer edge and a surface portion that is defined by an angle with a surface of the gear bar.

2. The refrigeration appliance of claim 1, the gear bar assembly further comprising:

a second gear coupled to the gear bar, the second gear with gear teeth extending from a base of the second gear;

a gear holder attachable to the gear, the gear holder attached to a refrigerator liner of the refrigeration compartment;

a second gear holder attachable to the second gear, the second gear holder attached to the refrigerator liner; and a second toothed strip positioned adjacent to the second gear and in contact with the gear teeth of the second gear in response to the drawer being opened or closed, wherein the toothed strip and second toothed strip are configured to be affixed to the bottom portion of the drawer.

3. The refrigeration appliance of claim 2, wherein the gear holder is attachable to the gear by snap fit and wherein the second gear holder is attachable to the second gear by snap fit.

4. The refrigeration appliance of claim 1, wherein the gear bar is coupled to the gear with a snap fit.

5. The refrigeration appliance of claim 1, wherein, for each gear tooth, the surface portion is angled to reduce a contact area between the flat outer edge and the toothed strip.

6. The refrigeration appliance of claim 1, wherein the gear bar and the gear are configured to be embedded in the base of the drawer, and wherein the toothed strip is configured to be positioned on a liner of the refrigeration compartment or on top of a glass plate.

7. The refrigeration appliance of claim 6, wherein, for each gear tooth, the surface portion is angled to reduce a contact area between the flat outer edge and the toothed strip.

8. A drawer assembly for a refrigeration compartment of a refrigeration appliance, the drawer assembly comprising:

a drawer positioned in the refrigeration compartment; and a gear bar assembly positioned under a bottom portion of the drawer, the gear bar assembly configured to reduce or eliminate a wobble of the drawer in response to the drawer being opened or closed, the gear bar assembly comprising:

a gear with gear teeth extending from a base of the gear;

a gear bar coupled to the gear; and a toothed strip positioned adjacent to the gear and in contact with the gear teeth in response to the drawer being opened or closed, wherein each gear tooth of the gear teeth comprises a flat outer edge and a surface portion that is defined by an angle with a surface of the gear bar.

9. The drawer assembly of claim 8, further comprising:

a second gear coupled to the gear bar, the second gear with gear teeth extending from a base of the second gear;

a gear holder attachable to the gear, the gear holder attached to a refrigerator liner of the refrigeration compartment;

a second gear holder attachable to the second gear, the second gear holder attached to the refrigerator liner; and a second toothed strip positioned adjacent to the second gear and in contact with the gear teeth of the second gear in response to the drawer being opened or closed, wherein the toothed strip and the second toothed strip are configured to be affixed to the bottom portion of the drawer.

10. The drawer assembly of claim 9, wherein the gear holder is attachable to the gear by snap fit and wherein the second gear holder is attachable to the second gear by snap fit.

11. The drawer assembly of claim 8, wherein the gear bar is coupled to the gear with a snap fit.

12. The drawer assembly of claim 8, wherein, for each gear tooth, the surface portion is angled to reduce a contact area between the flat outer edge and the toothed strip.

13. The drawer assembly of claim 8, wherein the gear bar and the gear are configured to be embedded in the bottom portion of the drawer, and wherein the toothed strip is configured to be positioned on a liner of the refrigeration compartment or on top of a glass plate.

14. The drawer assembly of claim 13, wherein, for each gear tooth, the surface portion is angled to reduce a contact area between the flat outer edge and the toothed strip.

15. A method comprising:

positioning a drawer in a refrigeration compartment of a refrigerator;

positioning a gear bar assembly under a bottom portion of the drawer to reduce or eliminate a wobble of the drawer in response to the drawer being opened or closed;

coupling a gear bar of the gear bar assembly to a gear of the gear bar assembly, the gear having gear teeth extending from a base of the gear; and positioning a toothed strip of the gear bar assembly adjacent to the gear and in contact with the gear teeth in response to the drawer being opened or closed, wherein each gear tooth of the gear teeth comprises a flat outer edge and a surface portion that is defined by an angle with a surface of the gear bar.

16. The method of claim 15, further comprising:

coupling the gear bar to a second gear with gear teeth extending from a base of the second gear;

attaching a gear holder to a refrigerator liner of the refrigeration compartment;

attaching the gear holder to the gear;

attaching a second gear holder to the refrigerator liner;

attaching the second gear holder to the second gear;

positioning a second toothed strip of the gear bar assembly adjacent to the second gear and in contact with the gear teeth of the second gear in response to the drawer being opened or closed; and affixing the toothed strip and the second toothed strip to the bottom portion of the drawer.

17. The method of claim 16, wherein attaching the gear holder to the gear involves attaching the gear holder to the gear with a snap fit.

18. The method of claim 15, wherein coupling the gear bar to the gear involves coupling the gear bar to the gear with a snap fit.

19. The method of claim 15, wherein, for each gear tooth, the surface portion is angled to reduce a contact area between the flat outer edge and the toothed strip.

20. The method of claim 15, further comprising:

embedding the gear bar and the gear in the bottom portion of the drawer; and positioning the toothed strip on a liner of the refrigeration compartment or on top of a glass plate.

* * * * *